US006577045B1

(12) United States Patent
Blyablin et al.

(10) Patent No.: US 6,577,045 B1
(45) Date of Patent: Jun. 10, 2003

(54) COLD-EMISSION FILM-TYPE CATHODE AND METHOD FOR PRODUCING THE SAME

(76) Inventors: Alexandr Alexandrovich Blyablin, ul. Ramenky, 9-1-85, 117607 Moscow (RU); Anton Valerievich Kandidov, ul. Klinskaya, 21-37, 125414 Moscow (RU); Mikhail Arkadievich Timofeev, ul. Dolgoprudnaya 13-2-6, 127484 Moscow (RU); Boris Vadimovich Seleznev, Volokolamskoye sh., 13-234, 127484 Moscow (RU); Andrei Alexandrovich Pilevsky, ul. Typolyy Stan, 4-1-47, 117139 Moscow (RU); Alexandr Tursunovich Rakhimov, Rostovskaya nab., 1-95, 119121 Moscow (RU); Nikolai Vladislavovich Suetin, pr. Lenina, 20f-36, 144005 Elektrostal (RU); Vladimir Anatolievich Samorodov, Nakhabino, Insthutskaya ul., 4-19, 143430 Moskovskaya obl. (RU)

( * ) Notice: Subject to any disclaimer, the term of this patent is extended or adjusted under 35 U.S.C. 154(b) by 0 days.

(21) Appl. No.: 09/700,694

(22) PCT Filed: Jan. 19, 2001

(86) PCT No.: PCT/RU99/00166

§ 371 (c)(1),
(2), (4) Date: May 19, 1999

(87) PCT Pub. No.: WO99/60597

PCT Pub. Date: Nov. 25, 1999

(30) Foreign Application Priority Data

May 19, 1998 (RU) ..... 98109664

(51) Int. Cl.[7] ..... H01J 19/00; B05D 3/00

(52) U.S. Cl. ..... 313/311; 313/346 R; 427/577

(58) Field of Search ..... 313/311, 346 R, 313/310, 346 DC, 355, 326; 427/577, 249.8, 249.11, 249.7, 249.1, 122; H01J 19/06; B05D 3/00

(56) References Cited

U.S. PATENT DOCUMENTS

| | | | | | |
|---|---|---|---|---|---|
| 5,675,216 | A | * | 10/1997 | Kumar et al. | 313/491 |
| 5,686,791 | A | * | 11/1997 | Kumar et al. | 313/310 |
| 5,703,435 | A | * | 12/1997 | Kumar et al. | 313/309 |
| 5,861,707 | A | * | 1/1999 | Kumar | 257/77 |
| 5,908,699 | A | * | 6/1999 | Kim | 428/408 |
| 6,042,900 | A | * | 3/2000 | Rakhimov et al. | 427/249.11 |
| 6,127,773 | A | * | 10/2000 | Kumar et al. | 313/309 |

FOREIGN PATENT DOCUMENTS

| | | | |
|---|---|---|---|
| EP | 0087826 | 9/1983 | H01J/9/04 |
| EP | 0687018 | 4/1996 | H01J/9/02 |
| RU | 71326 | 12/1947 | H01J/9/00 |
| RU | 966782 | 10/1982 | H01J/9/02 |
| RU | 2083018 | 6/1997 | H01J/1/30 |
| RU | 2099808 | 12/1997 | H01J/9/02 |

* cited by examiner

*Primary Examiner*—Don Wong
*Assistant Examiner*—Trinh Vo Dinh
(74) *Attorney, Agent, or Firm*—Collard & Roe, P.C.

(57) ABSTRACT

The present invention may be used in the production of highly efficient films for electron field emitters. The cold-emission cathode of the present invention comprises a substrate having a carbon film with an irregular structure applied thereon. This structure comprises carbon micro- and nano-ridges and/or micro- and nano-threads which are perpendicular to the surface of the substrate, which have a typical size of between 0.005 and 1 micron as well as a distribution density of between 0.1 and 100 $\mu m^{-2}$, and which are coated with a diamond nano-film whose thickness represents a fraction of a micron. The method for producing the cathode involves sequentially depositing two carbon films. A carbon film with nano-barbs is first deposited on a substrate arranged on an anode by igniting a direct-current discharge at a density of between 0.15 and 0.5 A. This deposition is carried out in a mixture containing hydrogen and a carbon-containing additive, under a global pressure of between 50 and 300 torrs, using vapors of ethylic alcohol at a 5 to 15% concentration or vapors of methane at a 6 to 30% concentration, and at a temperature on the substrate of between 600 and 1100° C. A diamond nano-film is then deposited on the graphite film thus grown.

7 Claims, No Drawings

COLD-EMISSION FILM-TYPE CATHODE AND METHOD FOR PRODUCING THE SAME

FIELD OF USE

Invention relates to fabrication of films for highly effective field emitters of electron which can be used to produce flat panel displays, electron microscopes, microwave electronics, light source and for some other applications.

PRIOR ART

Cold emission film cathode is known which comprises a substrate coated with a diamond film [Application of Diamond Films and Related Materials: Third International Conference, 1995, NIST Special Publication 885, Edited by A. Feldman et al., p.37, p.61]. But because of a low density of emitting centers the film cathode on a basis of polycrystalline diamond films is not a highly effective emitter.

The most relevant to the present invention is a cold emission film cathode comprising a substrate coated with a carbon film ["Diamond based field emission flat panel displays" Solid State Techn., 1995, May, p.71]. The film deposited on the substrate is a film of amorphous carbon A method is known to produce a cold emission film cathode by a method of laser sputtering ["Diamond based field emission flat panel displays" Solid State Techn. 1995, May, p,71], which comprises the deposition on a cold substrate of carbon evaporated from a graphite target by powerful laser radiation. Shortcoming inherent to this method is its complexity, high cost, limited scaling up capability, and also the low density of emitting centers (about 1000 per sq.cm in the electrical field of 20 V/micron) what is apparently insufficient for creation of a film color display with 256 grades of brightness.

A method is known to produce a cold emission film cathode by a method of plasma chemical vapor deposition comprising a DC glow discharge in an electrode gap between cathode and anode filled with hydrogen, beating a substrate up to the deposition temperature, injection of a carbon containing gas into flow and deposition of a film from a mixture of hydrogen and carbon containing gas, removing of excessive graphite phase by a discharge in hydrogen flow [A. T. Rakhimov, D. V. Selcznev, N. V. Suetin et al. Applications of Diamond Films and Related Materials: Third International Conf., Gaithersburg, Md., USA, 1995, NISTIR 5692, Supplement NIST Special Publication 885, p.11g]. Thus the nano-diamond film cathodes are produced. But the diamond films produced by this method grow very slowly and often do not possess emissive properties sufficient for creation of a full color display.

A method is known to produce a carbon cathode [USSR Authorship Certificate No 966782, IPC, publ.] comprising deposition of carbon filamentary crystals from a mixture of hydrogen, carbon dioxide and methane in the ratio of 15–25/74–83/1–2 and deposition of the carbon phase on a substrate at a temperature of 1200–1500° C. But so produced films possess rather non uniform emissive performances and low density of emitting centers.

DETAILED DESCRIPTION OF THE INVENTION

Requirements to the modern devices require the creation of a cold emission film cathode possessing high electron emissive performances and resistant to strong electrical fields, which can be used as a field emitter of electrons for production of flat panel displays, electron microscopes, microwave electronics, light sources and for some other applications.

This task can be solved due to that the cold emission film cathode is made as a substrate coated with a carbon film deposited on it in the form of a structure of irregularly located carbon micro- and nano-ridges and/or micro- and nano-threads normally oriented to the substrate surface and having typical size of 0.005–1 micron and density of 0.1–100 $\mu m^{-2}$, and additionally coated with the second carbon film in the form of nano-diamond film which thickness is 0.1–0.5 microns.

Method of fabrication of the cold emission film cathode comprises a sequential deposition of two carbon films: carbon nanotip film on a substrate placed on an anode, due to a DC glow discharge in a mixture of hydrogen and carbon containing gas; and deposition of nano-diamond film above the grown graphite film. Deposition of nano-diamond film above the grown graphite film is made either in the same DC discharge or via a technology employing a hot filament as an activator of the process.

On a first stage a DC glow discharge is ignited at a current density of 0.15–0.5 A/sq.cm, and deposition is carried out in a mixture of hydrogen and carbon containing admixtures at a total pressure of 50–300 Torr, and in particular the ethyl alcohol vapor at concentration of 5–15% or methane at concentration of 6–30% and substrate temperature of 600–1100° C. Also vapors of other carbon containing admixtures can be used, provided that a molar carbon content shall be retained. The gas mixture can be dissolved with an inert gas, e.g. argon, up to 75% at keeping the total pressure unchanged. Deposition of second carbon layer of the nanodiamond structure can be made by depositing of it from plasma of a DC discharge at the same parameters but reducing the concentration of carbon containing admixture down to 0.5–4% or deposition of nanodiamond layer can be made by chemical vapor deposition comprising a heating of metallic filament-activator up to temperature of 1800–2500° C., and of a substrate—up to temperature 600–1100° C., and depositing a film in a mixture of hydrogen and carbon containing admixture at a concentration of 0.5–10% through a grid screen placed between the filament and substrate.

If concentration of ethyl alcohol vapor concentration is less than 5% or methane concentration is less than 6% and pressure is less than 50 Torr, then a nucleation is slowed down leading to a higher non uniformity of the emission characteristics. Also a texture of films changes. If concentration of ethyl alcohol vapor concentration is more than 15% or methane concentration is more than 30% and pressure is more than 300 Torr, then discharge is subjected to instability. If current density exceeds 0.5 A/sq.cm the gas and substrates are subjected to an overheating resulting in a worsening of a film emission performances.

If current density is less than 0.15 A/sq.cm the required activation of gas media is not provided.

Substrate temperature less than 600° C. or more than 1100° C. results in a pronounced change of the film texture and loss of emissive properties.

In case if a DC discharge is used on a second stage and if a carbon containing admixture concentration is more than 4% then a globule-like carbon film grows on the substrate surface with typical size of globules of more than 1 micron and having extremely poor emissive performances.

If a carbon containing admixture concentration is less than 0.5% then an abrupt decreasing of growth rate or even etching of the film grown on a first stage takes place.

In case if a hot filament activation is used on a second stage and if its temperature is less than 1800° C. then no needed activation of the gas occurs. If its temperature is more than 2500° C. then the filament life is too short. If substrate is heated up to a temperature less than 600° C. or more than 1100° C. then either graphite or film with unacceptably poor emissive performances is produced.

PREFERRED EMBODIMENTS OF THE METHOD

The method to produce a cold emission film cathode in a DC discharge can be performed in a chamber equipped with vacuuming and gas supply systems providing feeding and control over the gas mixture of hydrogen and carbon containing admixtures. Discharge is ignited between two electrodes connected to a electrical power supply system. Anode is used as a substrate holder, a silicon plate of 400 microns thickness can be used as a substrate. Prior deposition the substrate was treated with a diamond suspension using one of the standard techniques to increase concentration of the nucleation centers. In particular, an ultrasonic treatment can be used during 20–40 min. Another method to create the nucleation centers originates from a catalytic properties of some metals (Fe, Co, Ni, etc) which are to be deposited on the substrate at a thickness of 10–100 nm.

Deposition was carried out in a gas mixture of hydrogen and ethyl alcohol vapor (5–10%) at a pressure of 50–300 Torr. Substrate temperature which is determined by the discharge power, special heater and cooling system was monitored with an optical pyrometer and was measured accounting the responding corrections to be ranged as 700–1100° C. Current density was 0.3–0.4 A/sq.cm. At such conditions a carbon film growth was provided up to 10 microns/hour. Any material can be used as a substrate which is resistant to deposition temperature and possesses high adhesion to carbon.

Similar film texture was obtained using methane at concentration of 6–15% and some other hydrocarbon gases (acetylene, propane, etc) at the same parameters of deposition process.

Thus obtained films possess rather high emissive performances but it is not enough stable. It causes breakdown during emission due to microparticles sputtered from the film surface.

To improve the emissive and adhesive properties of the film, a nanodiamond film 0.1–0.5 microns thick was deposited on the first one on a second stage. It is Tane in the same DC discharge. For this purpose the carbon containing gas (in this case—methane) content in hydrogen was reduced down to 0.5–2% at current density of 0.3–0.4 A/sq.cm and substrate temperature of 850–950° C.

Also nanodiamond film about 0.1–0.5 microns thick can be deposited by a hot filament technique. For this purpose the substrate coated with a carbon film deposited on a first stage was placed into a reactor implementing thermal activation of the gas mixture. Parameters of deposition were as follows: pressure of hydrogen-methane mixture—15–25 Torr, methane concentration—3%, filament temperature—2100–2500° C. substrate temperature–800–900° C.

SEM (scanning electron microscope) images of the carbon films evidence that the films deposited on a first stage appear to be the textures in the form of micro and nano-ridges which are oriented normally to the surface. The surface of the films after second stage is coated with nanocrystallites which reduce the emission threshold and improve tee film durability.

Uniformity of emission was derived from a phosphor luminescence distribution which brightness is proportional to density of incident electron beam. It was found that emission current distribution is quite uniform and density of emission centers is so high that they can't be visually resolved.

The density of emission centers was quantitatively measured by STM (scanning tunneling microscope) to be about $10^6$ per sq.cm what is sufficient to create an emission display.

The volt-ampere characteristics of the emission current show that the emission threshold is comparatively low and the current density can exceed 500 mA/sq.cm in the filed of about 10 V/micron.

Cold emission cathode fabricated using the suggested methods possesses high emissive performances, stable in high electrical fields, chemically resistant and therefore can be used to create flat panel displays, in electron microscopes, microwave electronics, light sources and some other applications.

APPLICABILITY IN INDUSTRY

The use of the two-stage deposition allows broadly apply it for selective deposition and formation of addressing communication. It is possible to do on a stage of nucleation, e.g. via masking of a catalyst film with a needed pattern by a standard lithographic technique. It was demonstrated with Fe, Ni and Co. Another possible approach is to create a pattern after first stage of deposition. In this case also photoresist can be used without any affect to the emissive performances because deposition of emitting surface is carried out on a second stage.

What is claimed is:

1. A cold emission film cathode comprising a substrate coated with a first carbon film and a second carbon film deposited above said first carbon film, said first carbon film being made in the form of a structure of irregularly located carbon micro and nano-ridges and/or micro or nano-threads normally oriented to the substrate surface and having a typical size of between 0.005 and 1 micron and a distribution density of between 0.1 and 100 $\mu m^{-2}$, said second carbon film being made in the form of a nano-diamond film which thickness is 0.1–0.5 microns.

2. Method to produce a cold emission film cathode comprising deposition on a substrate of a carbon film placed on an anode of the carbon film by a deposition form a mixture of hydrogen and carbon containing gas, wherein said deposition of the carbon film is made from plasma of a DC glow discharge at current density of 0.15–0.5 A/sq.cm in a mixture of hydrogen and carbon containing admixture at a total pressure of 50–300 Torr and substrate temperature of 600–1100° C., and above the first carbon film a second carbon film is deposited in the form of a nanodiamond layer.

3. Method set forth in claim 2 wherein the carbon containing admixture is ethyl alcohol vapor at concentration of 5–15%.

4. Method set forth in claim 2 wherein the carbon containing admixture is methane at concentration of 6–30%.

5. Method set forth in claim 2 wherein the deposition of said nanodiamond layer is made from plasma of a DC glow discharge at current density of 0.15–0.5 A/sq.cm in a mixture of hydrogen and carbon containing admixture at a concentration of 0.5–4%, total pressure of 50–300 Torr and substrate temperature of 600–1100° C.

6. A method according to claim 2 wherein the deposition is made with adding into said gas mixture an inert gas under constant pressure.

7. A method according to claim 2 wherein the deposition of said nanodiamond layer is made by chemical vapor deposition comprising the steps of heating a metallic filament to a temperature in the range of 1800–2500 degrees C., heating a substrate to a temperature in the range of 600–1100 degrees C., and depositing a film in a mixture of hydrogen and carbon containing admixture at a concentration of 0.5–10% through a grid screen placed between the filament and the substrate.

* * * * *

UNITED STATES PATENT AND TRADEMARK OFFICE

CERTIFICATE OF CORRECTION

PATENT NO. : 6,577,045 B1
DATED : June 10, 2003
INVENTOR(S) : Blyablin et al.

It is certified that error appears in the above-identified patent and that said Letters Patent is hereby corrected as shown below:

Column 4,
Line 46, after the word "deposition", please change the word "form" to -- from --.

Signed and Sealed this

Seventeenth Day of August, 2004

JON W. DUDAS
*Acting Director of the United States Patent and Trademark Office*